US009695996B2

(12) United States Patent
Dobbs

(10) Patent No.: US 9,695,996 B2
(45) Date of Patent: Jul. 4, 2017

(54) SOLAR-POWERED ROADWAY DELINEATOR

(71) Applicant: Blaine Alan Dobbs, Sugar Land, TX (US)

(72) Inventor: Blaine Alan Dobbs, Sugar Land, TX (US)

(73) Assignee: INQ-Energy, Inc., Stafford, TX (US)

( * ) Notice: Subject to any disclaimer, the term of this patent is extended or adjusted under 35 U.S.C. 154(b) by 186 days.

(21) Appl. No.: 14/203,918

(22) Filed: Mar. 11, 2014

(65) Prior Publication Data

US 2014/0268699 A1 Sep. 18, 2014

Related U.S. Application Data

(60) Provisional application No. 61/851,664, filed on Mar. 12, 2013.

(51) Int. Cl.
*F21V 1/00* (2006.01)
*F21V 11/00* (2015.01)
(Continued)

(52) U.S. Cl.
CPC ..... *F21L 4/08* (2013.01); *E01F 9/615* (2016.02); *E01F 9/617* (2016.02); *E01F 9/669* (2016.02)

(58) Field of Classification Search
CPC . E01F 9/016; E01F 9/0165; E01F 9/03; E01F 9/065; E01F 9/0118; E01F 9/0112; E01F 9/0111; E01F 9/007; E01F 9/013; E01F 9/019; E01F 9/00; E01F 9/547; E01F 9/559; E01F 9/582; E01F 9/615; E01F 9/617; F21L 4/04; F21L 4/02; F21L 4/00;
(Continued)

(56) References Cited

U.S. PATENT DOCUMENTS 5,252,893 A 10/1993 Chacham et al.
5,633,565 A 5/1997 Friedman et al.
(Continued)

FOREIGN PATENT DOCUMENTS

CN 2012-25548 Y 4/2009
CN 2014-40304 U 4/2010
(Continued)

OTHER PUBLICATIONS

Machine translation of Takeyama et al., JP H10-298933A, Published Nov. 10, 1998.*
(Continued)

*Primary Examiner* — Peggy Neils
*Assistant Examiner* — William N Harris
(74) *Attorney, Agent, or Firm* — Finnegan, Henderson, Farabow, Garrett & Dunner, L.L.P.

(57) ABSTRACT

Embodiments of the present disclosure relate to roadway delineators with one or more light sources that provide illumination and increased visibility. In one implementation, the delineator is operable between a stowed configuration and a deployed configuration. The delineator may include a plurality of panels with flexible connections that connect the panels to one another and allow the delineator to be collapsed. In addition, the delineator may be self-powered and include a solar array and/or a rechargeable power source for the one or more light sources.

22 Claims, 12 Drawing Sheets

(51) Int. Cl.
*F21L 4/08* (2006.01)
*E01F 9/669* (2016.01)
*E01F 9/615* (2016.01)

(58) Field of Classification Search
CPC ..... F21V 15/012; F21V 21/30; G09F 2013/0463; G09F 2013/0472; B60Q 7/00
USPC ..... 362/233, 220, 238, 269, 270, 285, 287
See application file for complete search history.

(56) References Cited

U.S. PATENT DOCUMENTS

| | | | | |
|---|---|---|---|---|
| 6,488,391 | B1 * | 12/2002 | Gary | B44C 3/12 248/150 |
| 7,824,068 | B2 * | 11/2010 | Wulfinghoff | F21S 6/003 362/239 |
| 8,210,719 | B2 | 7/2012 | Chen | |
| 9,170,006 | B2 * | 10/2015 | Cugini | F21V 21/145 |
| 2005/0128105 | A1 * | 6/2005 | Green | B29C 39/10 340/944 |
| 2008/0069637 | A1 | 3/2008 | Mize et al. | |
| 2009/0303718 | A1 * | 12/2009 | Zheng | F21K 9/00 362/249.02 |
| 2010/0098488 | A1 * | 4/2010 | Huck | E01F 9/03 404/14 |
| 2012/0140468 | A1 * | 6/2012 | Chang | F21S 2/00 362/235 |
| 2013/0271993 | A1 * | 10/2013 | Jan | F21V 21/30 362/249.09 |
| 2014/0049956 | A1 * | 2/2014 | Manahan | F21V 21/14 362/233 |

FOREIGN PATENT DOCUMENTS

| | | | |
|---|---|---|---|
| EP | 0 523 903 | A2 | 1/1993 |
| EP | 2 369 059 | A2 | 9/2011 |
| JP | H10298933 | A | 11/1998 |

OTHER PUBLICATIONS

International Search Report and Written Opinion of the International Searching Authority for PCT International Application No. PCT/US2014/023217, mailed Jul. 8, 2014 (7 pages).
Aluminum IP68 Highway Road Reflector, Alibaba.com (last visited Mar. 3, 2014) www.alibaba.com/product-gs/1271351584/Aluminum_IP68_Highway_Road_Reflector.html?s=p.
Office Action mailed Jun. 2, 2016 for corresponding Chinese Patent Application No. 2014-800107191, 9 pages.

* cited by examiner

SOLAR-POWERED ROADWAY DELINEATOR

CROSS-REFERENCE TO RELATED APPLICATION(S)

This application claims the benefit of priority to U.S. Provisional Application No. 61/851,664, filed on Mar. 12, 2013, the entire disclosure of which is expressly incorporated herein by reference.

BACKGROUND

Technical Field

The present disclosure relates generally to solar-powered equipment and roadway reflectors and delineators. More particularly, and without limitation, the present disclosure relates to a collapsible road delineating apparatus including one or more solar-powered light sources for indicating roadway features.

Background Information

In low visibility conditions, such as fog, clouds, or rain, or at night, drivers often fail to notice roadway features or dangers. To alert drivers to these features or dangers, reflectors are often used. Reflectors passively bounce light back from vehicle headlights to indicate roadway features and obstacles. Because conventional reflectors provide no light sources of their own, such reflectors need bright headlights to work well and are most useful in clear conditions. However, even in the best conditions, reflectors may provide insufficient warning or information to drivers at long distances.

Fog, heavy rain, and/or other weather conditions can make conventional reflectors effectively useless, as they may reflect too little or insufficient light in these conditions. Similarly, if cars have damaged headlights, or if the reflector itself is dirty, the reflector may be insufficient to warn drivers or otherwise be recognized. Moreover, in well-lit construction sites and other areas, reflectors leave barriers all but unmarked, as the small reflection pales in comparison to ambient safety lighting.

Aiming to solve some of these problems, several devices use active light sources to indicate roadway features or dangers. For example, U.S. Pat. No. 5,252,893 discloses a rechargeable electronic flasher powered by a solar panel and a solar-rechargeable battery. Similarly, U.S. Pat. No. 8,210,719 discloses a solar-powered indicator for road railings. The devices of these patents use light emitting diodes (LEDs) and passive reflectors to signal road dangers.

Though these devices solve some problems of traditional reflectors, they create others. For example, such indicators may have bulky, voluminous bodies. Shipping such devices can increase costs, as few devices may be packed into a large volume. Further, devices designed for specialty purposes work poorly for other purposes. For example, the device disclosed in U.S. Pat. No. 5,252,893 is intended for roadway surfaces. Such devices may work poorly to delineate roadway barriers.

SUMMARY

This disclosure describes roadway delineators that may be attached to a roadway barrier and include one or more light sources that can indicate road features or dangers. The light sources may be viewed at long distances and in low-visibility weather. In accordance with some embodiments, the delineators may provide an easily installed, low maintenance, off-the-grid, self-powered, stand-alone, long-lasting nighttime illumination and marking device for use with barriers used on highways and rural roads to alert motorists as to where the barriers have been placed, for example. Delineators consistent with the present disclosure can be used on straight stretches of highways and roads, as well as along curves and blind corners to facilitate safe traffic flow. Delineators consistent with the present disclosure can also be used with concrete highway barriers, jersey-type barriers, precast barriers, constant slope barriers, traffic barriers, truck barriers, median barriers, crash barriers, as well as other environments. By way of further examples, delineators consistent with the present disclosure can also be used on municipal roadways and parking lots.

In accordance with some embodiments, a delineator is provided that may be attached to a roadway barrier. The delineator includes a plurality of panels, a solar cell array, a rechargeable power source, and a light source powered by the rechargeable power source. The number and arrangement of these components may vary. For example, a plurality of solar cell arrays, rechargeable power sources, and/or light sources may be provided. Moreover, as further disclosed herein, the solar cell array, rechargeable power source, and light source may be attached to, or supported by, the panels.

In some embodiments, flexible connections connect the panels of the delineator such that the delineator is operable between a stowed configuration and a deployed configuration. In some embodiments, the panels, in the stowed configuration, are in one of the same or substantially parallel planes, and in the deployed configuration may be disposed in different planes.

It is to be understood that both the foregoing general description and the following detailed description are exemplary and explanatory only and are not restrictive of the embodiments of the present disclosure, as claimed.

BRIEF DESCRIPTION OF THE DRAWINGS

The accompanying drawings, which are incorporated in and constitute a part of this specification, illustrate several embodiments of the present disclosure and, together with the description, serve to explain the principles and features of the present disclosure.

DETAILED DESCRIPTION OF EXEMPLARY EMBODIMENTS

Reference will now be made in detail to embodiments of the present disclosure, examples of which are illustrated in the accompanying drawings. Wherever possible, the same reference numbers will be used throughout the drawings to refer to the same or like parts.

Figure 1:
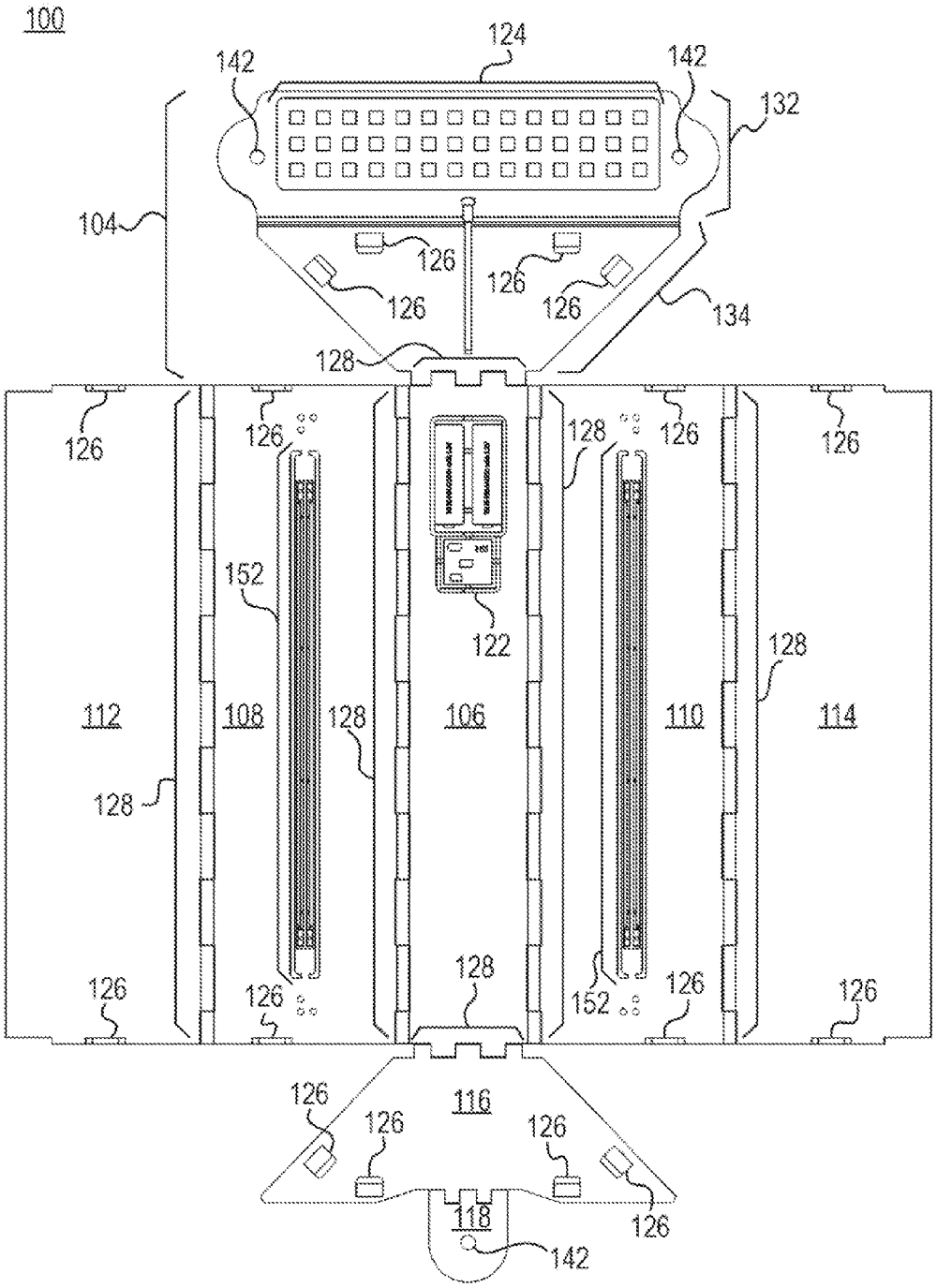
FIG. 1 is a plan view of an exemplary delineator in a stowed configuration, in accordance with embodiments of the present disclosure.

FIG. 1 is a plan view of an exemplary delineator 100, in accordance with embodiments of the present disclosure. In FIG. 1, delineator 100 is depicted in a laid flat view, showing the interior. Delineator 100 comprises a plurality of panels, including a top panel 104, a front panel 106, a left side panel 108, a right side panel 110, a left back panel 112, a right back panel 114, and a bottom panel 116. A mounting tab 118 is also provided. The number and configuration of these components is exemplary and provided for purposes of illustration. It will be appreciated from this disclosure that the number and configuration of these and the other illustrated components of delineator 100 may be modified or adjusted.

In some embodiments, panels 104-116 and mounting tab 118 are made of UV-resistant and/or weatherproof materials. Such materials include, but are not limited to, ABS, PVC, PP, or PE plastic. The weatherproof and UV resistant materials may help the panels to resist degradation in potentially harsh weather conditions where delineator 100 is installed. Alternatively, delineator 100 may be made of lower-cost or lower-grade materials if the duration of use is expected to be short or the conditions of the environment of use are more favorable or tolerable. In even more embodiments, delineator 100 may be made of metal.

Further displayed in FIG. 1 is a microcontroller 122. In one embodiment, microcontroller 122 is attached to front panel 106. Alternatively, microcontroller 122 can be mounted on any panel so that microcontroller 122 is protected from the weather and other elements. In some embodiments, microcontroller 122 is mounted externally, but protected by a sealant or covering.

In some embodiments, a rechargeable power source 120 is attached to front panel 106 of delineator 100. This may allow rechargeable power source 120 to be housed internally in the deployed configuration, as discussed below. Rechargeable power source 120 may include, for example, rechargeable batteries such as NiCad, or alternatively lithium ion batteries. Rechargeable power source 120 may also include a high-capacity rechargeable capacitor.

In FIG. 1, delineator 100 is shown in a stowed configuration where panels 104-116 are deployed in approximately the same plane. Configurations for other embodiments are possible, as discussed further below. The stowed configuration may allow multiple delineators 100 to be stacked, providing simpler, more efficient packing of the delineators 100 for shipment and storage. Delineator 100 may stow in a smaller volume than its deployed configuration and may allow for more delineators to be shipped to an installation site at less cost and with fewer vehicles. Additionally, or alternatively, delineators that were previously assembled into the deployed configuration may be later returned to the stowed configuration for storage. Road construction crews may use this feature to easily use, store, and/or reuse delineators.

FIG. 1 further illustrates a textured surface 124. Delineator 100 may be mounted to a barrier using epoxy, and textured surface 124 may help ensure adherence between the epoxy, panels 104, 112, and 114 of delineator 100, and a roadway barrier. In some embodiments, textured surface 124 consists of a plurality of squares. By way of example, the dimensions of the squares may be approximately 1 cm in width and 1 mm in thickness.

FIG. 1 also shows flexible connections 128 that connect panels 104-116. These connections allow delineator 100 to be operable between the stowed configuration and the deployed configuration. Flexible connections 128 run along the sides of adjacent panels 104-116, so that the panels may fold in relation to one another. In the exemplary embodiment shown FIG. 1, flexible connections 128 comprise a plurality of hinged mating edges that interlock to form a hinge along adjacent edges. A hinge wire may be run through each hinge such that panels 104-116 become foldable in relation to each other. In some embodiments, the delineator 100 may optionally include one or more mounting tabs (not shown in the figures) to assist with the mounting of the delineator.

In some embodiments, flexible connections 128 may be formed by or implemented with flexible material, such as a thin, durable plastic. In such cases, the plastic may form a connection between each panel that maintains elasticity, such that panels 104-116 are foldable in relation to one another. This elasticity allows panels 104-116 to be operable between the deployed configuration and stowed configuration. Alternatively, flexible connections 128 may be formed by snap in place and/or ball socket knuckle design to pivot the hinging panels 104-118.

Delineator 100 may also include a printed circuit board 152 on which a plurality of light sources 150, not pictured in FIG. 1, may be mounted. The printed circuit board 152 may be a wireless radio frequency printed circuit board. The printed circuit board 152 may be used for synchronous communication for sequential flashing of multiple delineator units. The ability to synchronously communicate may aid in traffic guidance.

Figure 2:
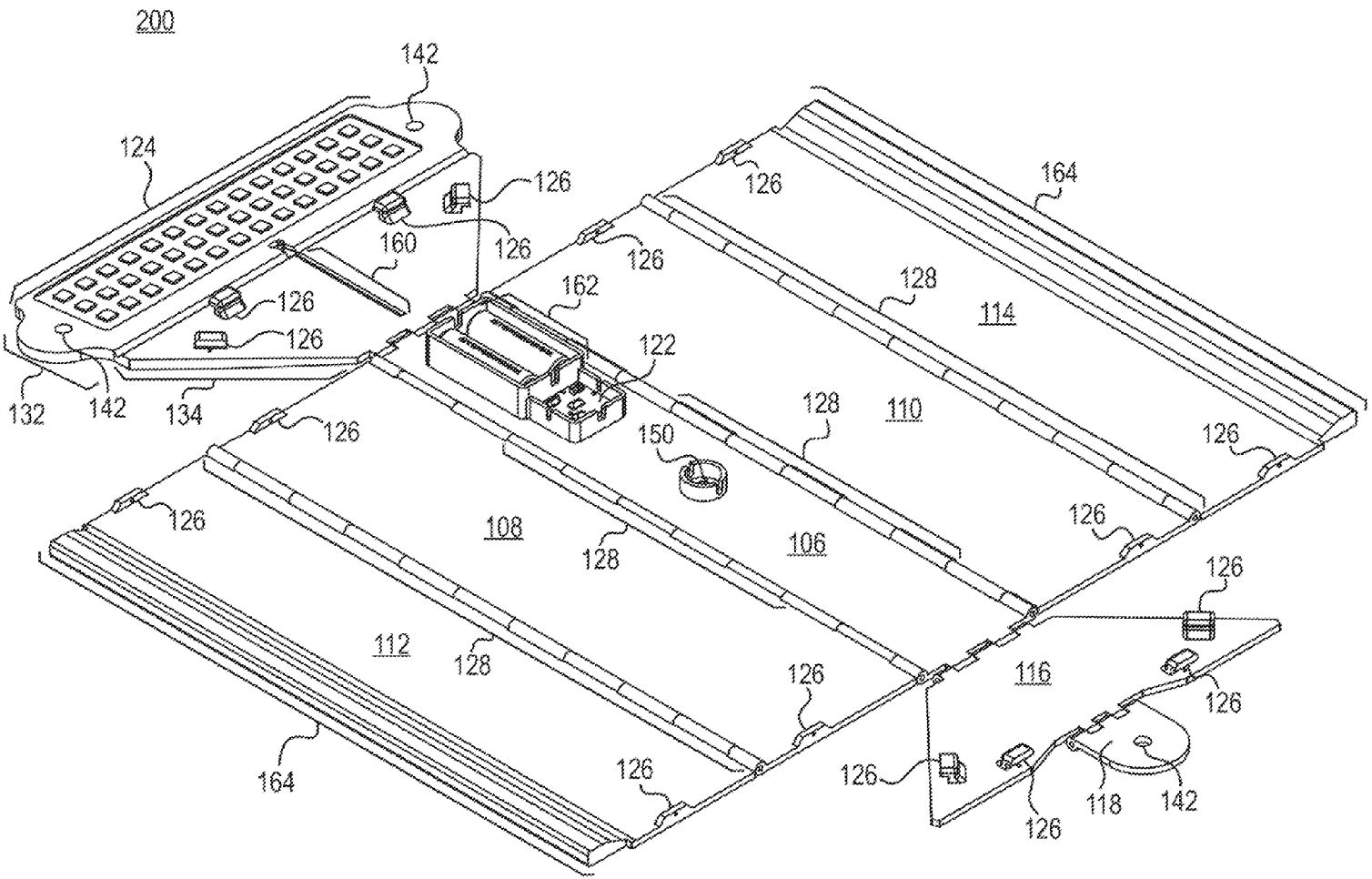
FIG. 2 is a perspective view of an exemplary delineator, in accordance with embodiments of the present disclosure.

FIG. 2 illustrates a detailed view of delineator 200, in accordance with embodiments of the present disclosure. This view shows a number of potential features for delineator 200. For example, delineator 200 may include wire guides 160 molded into panels 104-116. These wire guides can assist in cable management. Further illustrated in FIG. 2 are two removable, rechargeable batteries 162 that mount in a tray attached to front panel 106. Delineator 200 may also include a tray for the microcontroller 122, as shown in FIG. 2. Both the rechargeable batteries 162 and microcontroller 122 sit in the trays provided, and can be housed internally in the deployed configuration. Moreover, these trays in which the rechargeable batteries 162 and microcontroller 122 sit may be filled with epoxy to protect these electronic devices from moisture.

By way of further example, FIG. 2 discloses a pivot between first portion 132 and second portion 134 of top panel 104. This pivot is flexible so that first portion 132 may flexibly move in relation to second portion 134. This flexibility allows exterior angle 136, not shown in FIG. 2, to be a range of angles, described further below. FIG. 2 also illustrates a raised ridge 164 on right back panel 114 and left back panel 112. Raised ridge 164 of back panels 112 and 114 may allow for greater strength of the panel. These ridges may help provide a sturdy mounting surface for the delineator when it is mounted to a roadway barrier.

In the exemplary embodiment shown in FIG. 2, top panel 104 is shown being roughly trapezoidal. Alternatively, top panel 104 may be triangular or square in shape. In a triangular embodiment, there is no front panel. Moreover, delineator 200 may have a bottom panel 116 also triangular in shape. In the deployed configuration, the triangular embodiment will form a triangular prism with top panel 104 and bottom panel 116 at each end. In this configuration, side panels 108 and 110 are perpendicular to the second portion 134 of top panel 104, and form interior angles with back panels 112 and 114 of less than 90 degrees.

FIG. 2 further discloses a single light source 150 installed on front panel 106. The light source 150 here is shown from behind, and its light would emanate on the opposite side of front panel 106. At least one light source 150 may be installed in left side panel 108. It may also be installed on right side panel 110. As will be appreciated from this disclosure, the number and configuration of these components is exemplary and provided for purposes of illustration. It will also be appreciated from this disclosure that the number and configuration of these and the other illustrated components of delineator 200 in FIG. 2 may be modified or adjusted.

Figure 3:
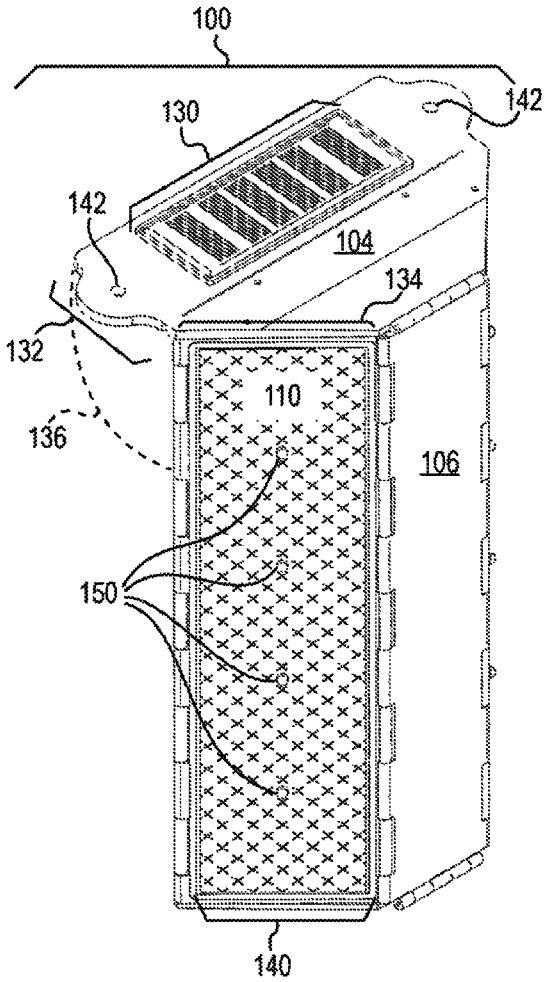
FIG. 3 is a perspective view of an exemplary delineator in a deployed configuration, in accordance with embodiments of the present disclosure.
Figure 4:
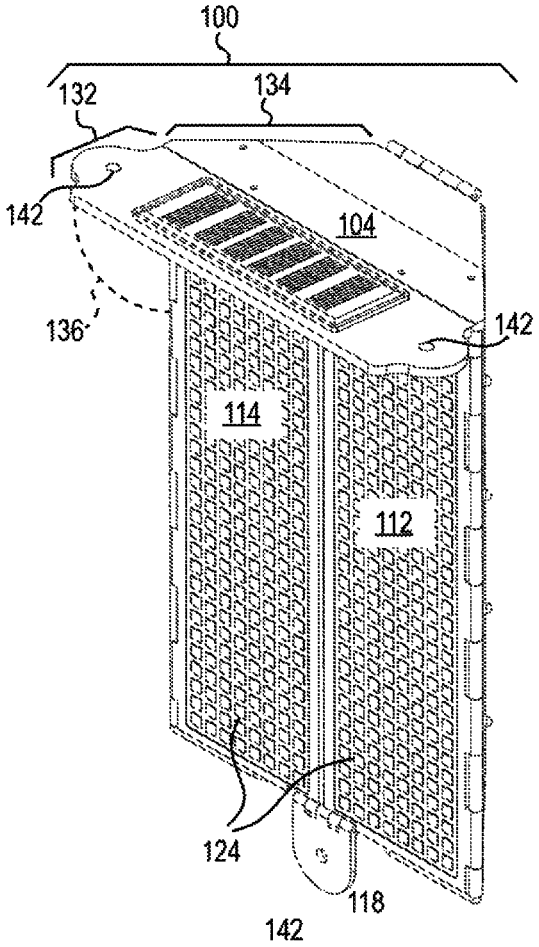
FIG. 4 is perspective view of an embodiment of an exemplary delineator in a deployed configuration in accordance with the disclosure.

FIGS. 3 and 4 depict delineator 100 assembled in a deployed configuration from two different perspective views, consistent with embodiments of the present disclosure. Both figures show an external view of the deployed delineator 100. FIG. 3 depicts top panel 104, front panel 106, and right side panel 110. FIG. 4 depicts top panel 104, left back panel 112, and right back panel 114. A solar cell array 130 and a plurality of light sources 150 are mounted to panels 104-116. The deployed configuration may create a delineator 100 with a hollow, lightweight body.

Consistent with embodiments of the present disclosure, solar cell array 130 may provide energy to rechargeable power source 120. Light sources 150 are electrically connected to rechargeable power source 120, as shown in FIG. 1. Light sources 150 may be implemented using LEDs and/or other suitable light sources. Light sources 150 may be mounted on a printed circuit board 152, as shown in FIG. 1. Further, light sources 150 may be DPI and/or SMT LEDs. In some embodiments, solar cell array 130 is a rectangular mono-crystalline solar panel. Alternatively, solar cell array 130 can be any type of solar photovoltaic. For example, solar cell array 130 may comprise Monocrystalline silicon (mono-Si), also called single-crystalline silicon (single-crystal-Si), Polycrystalline silicon, which also is known as polysilicon (p-Si), multi-crystalline silicon (mc-Si), Crystalline Silicon (c-Si), and thin-film photovoltaic cells (TFPV), among others. Solar cell array 130 charges rechargeable power source 120, as depicted in FIG. 1, so this power source can be small, easily portable and have limited energy capacity.

Microcontroller 122, seen in FIG. 1, controls the operation of light sources 150. Light sources 150 will operate in certain conditions, controlled by microcontroller 122. For example, microcontroller 122 can be programmed to operate light sources 150 only in low light conditions. Further, light sources 150 may be operated in different patterns of on and off to create various blinking effects, all controlled by microcontroller 122. Further still, microcontroller 122 can be programmed to operate light sources 150 at a specific time to correspond with events such as construction crew work schedules. In some embodiments, delineator 100 comprises a printed circuit board supporting microcontroller 122.

FIGS. 3 and 4 disclose an exemplary embodiment in which mounting holes 142 are provided in panels 104-116 for mechanically mounting delineator 100. For example, top panel 104 comprises two mounting holes 142 on opposing sides of solar cell array 130. Further, mounting tab 118 comprises one mounting hole 142. Mounting holes 142 allow for a screw, nail, or similar mechanical mounting device to be inserted through mounting holes 142 and into a barrier. Delineator 100 may be mounted in the deployed configuration.

In the exemplary embodiment of FIGS. 3 and 4, top panel 104 comprises first portion 132 and second portion 134. In this deployed configuration, second portion 134 is perpendicular to back, side, and front panels 106-114, and serves to enclose the upper end of delineator 100 in the deployed configuration.

Top panel 104 extends beyond back panels 112 and 114 to further form first portion 132. This portion of top panel 104 extends beyond the body to facilitate mounting delineator 100 on a roadway barrier. In the deployed configuration, first portion 132 forms an exterior angle 136 with back panels 112 and 114. The exterior angle 136 may be any angle. The embodiment shown here demonstrates an exterior angle 136 of approximately 90 degrees, suitable for mounting on a barrier having a horizontal top surface. Once delineator 100 is installed, top panel 104 may support some of its weight.

FIG. 3 shows a row of light sources 150 and reflective tape 140 attached to right side panel 110. Light sources 150 are powered by rechargeable power source 120, which is in turn electrically connected to solar cell array 130. Reflective tape 140 passively reflects light from headlights and ambient light so that if rechargeable power source 120 fails, delineator 100 remains useful as a passive reflector. In the illustrated embodiments, light sources 150 are attached to side panels 108, not shown here, and 110. In still other embodiments, light sources 150 may be placed on any other panel.

In the exemplary embodiment in FIG. 4, back panels 112 and 114 are also textured on one face. In an embodiment, delineator 100 attaches to a roadway barrier using epoxy applied between both top and back panels 112 and 114 and a barrier, so this texture may help adherence of delineator 100 to the epoxy and roadway barrier.

Figure 5:
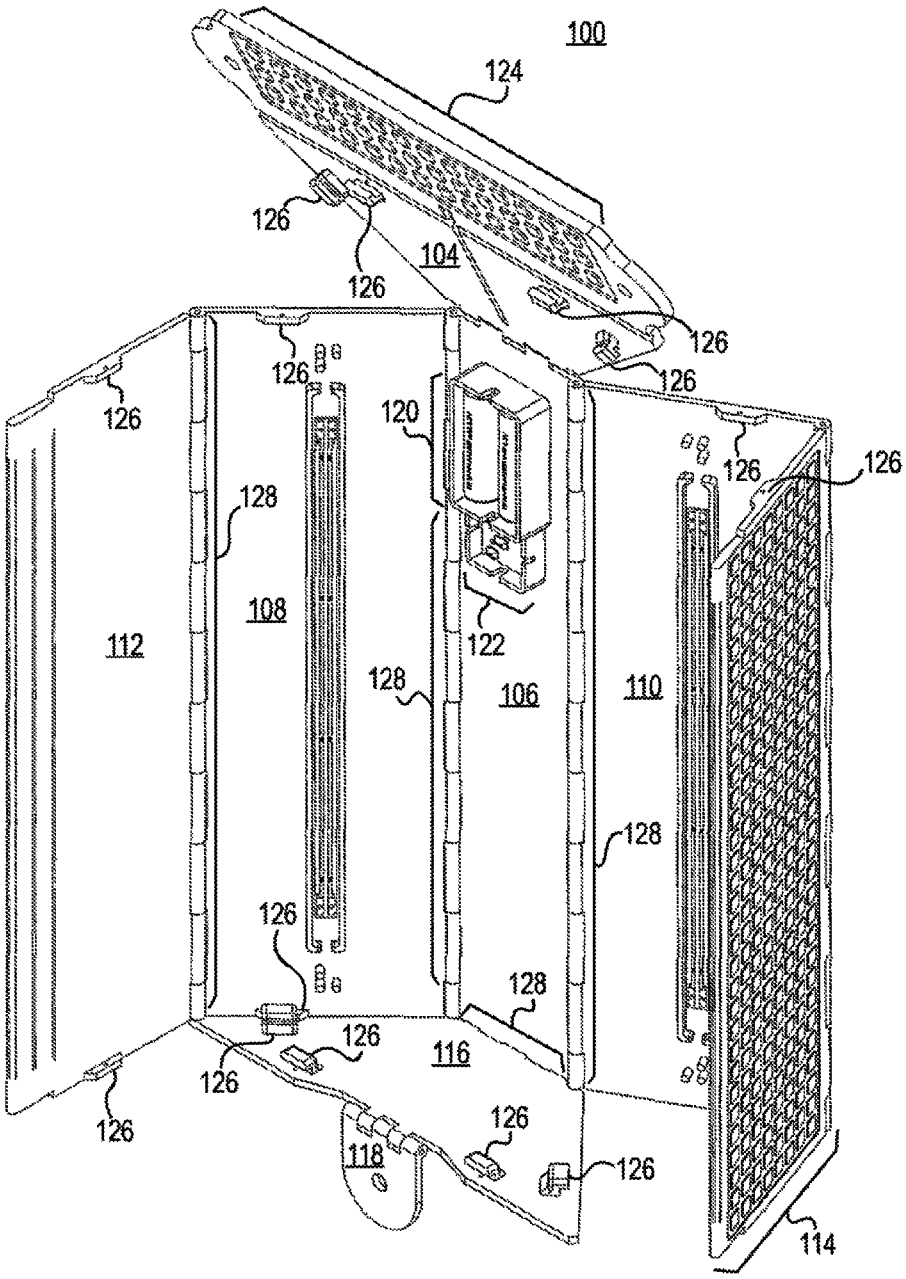
FIGS. 5-10 are perspective views of an exemplary delineator, in accordance with embodiments of the present disclosure.
Figure 6:
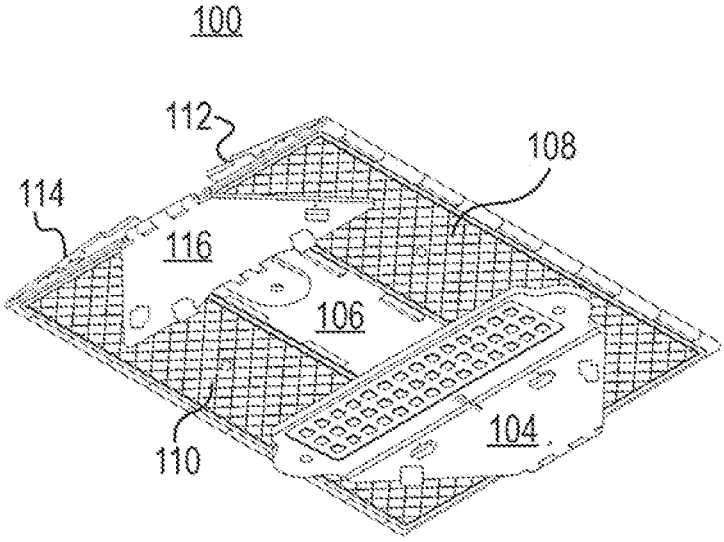
Figure 7:
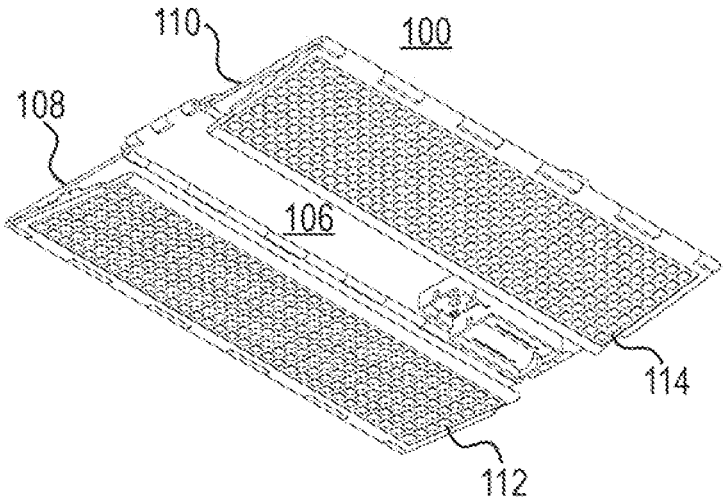
Figure 8:
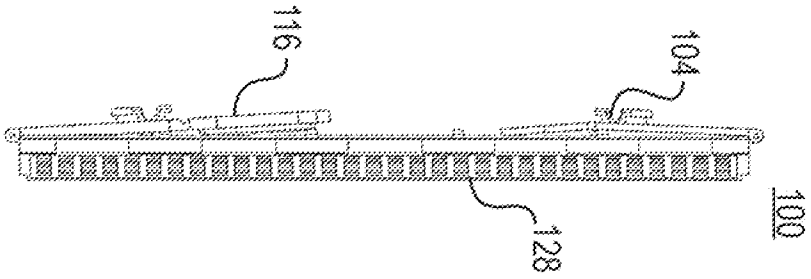
Figure 9:
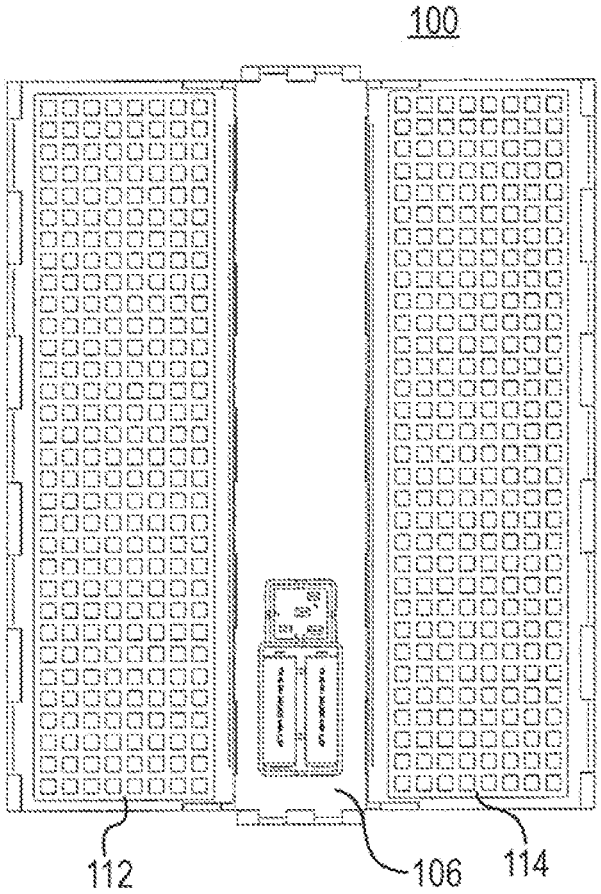
Figure 10:
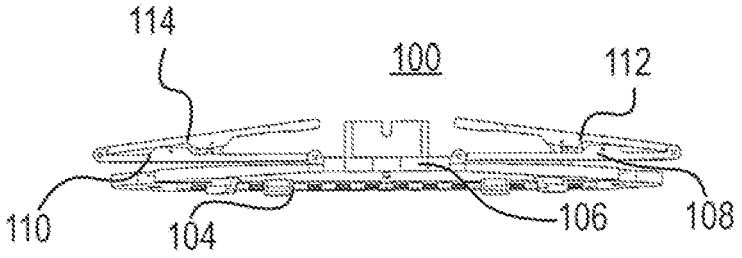

FIG. 5 is a perspective view of delineator 100 showing a configuration in the transition from the stowed configuration to the deployed configuration, consistent with embodiments of the present disclosure. In the deployed configuration, side panels 108 and 110 are perpendicular to bottom panel 116 and first portion 132 of top panel 104, and form interior angles with back panels 112 and 114 of less than 90 degrees. The deployed configuration of delineator 100 forms a body that can be attached to a roadway barrier, for example.

To maintain delineator 100 in the deployed configuration, delineator 100 may be provided with a plurality of securing members 126, as shown in FIG. 5. Securing members 126 may comprise male and female mating clips along the edges of panels 104-116. In the stowed position, securing members 126 are separate and in the deployed position they join to form secure connections that maintain the shape of the deployed delineator.

To operate delineator 100 between the stowed and deployed configuration, panels 104-116 are moved toward one another until pairs of securing members 126 meet. Securing members 126 form secure connections so that panels 104-116 do not fall back to the stowed configuration. In such embodiments, the secure connections may be formed by male and female connector clips. Alternatively, securing members 126 can comprise hook-and-loop fasteners to maintain the deployed configuration.

Once panels 104-116 are connected, delineator 100 is in the deployed configuration. In the deployed configuration panels 104-116 are disposed in different planes. The panels 104-116 are securely connected in the deployed configuration to maintain a shape that forms the body of delineator 100. The body protects the internal elements from wind, rain, and other potential harms.

FIGS. 6, 7, 8, 9, and 10 show various examples of delineator 100 in a stowed position. Panels 104-116, connected flexibly, stow in substantially parallel planes. These storage options may allow more delineators to be shipped in smaller volume containers.

Figure 11:
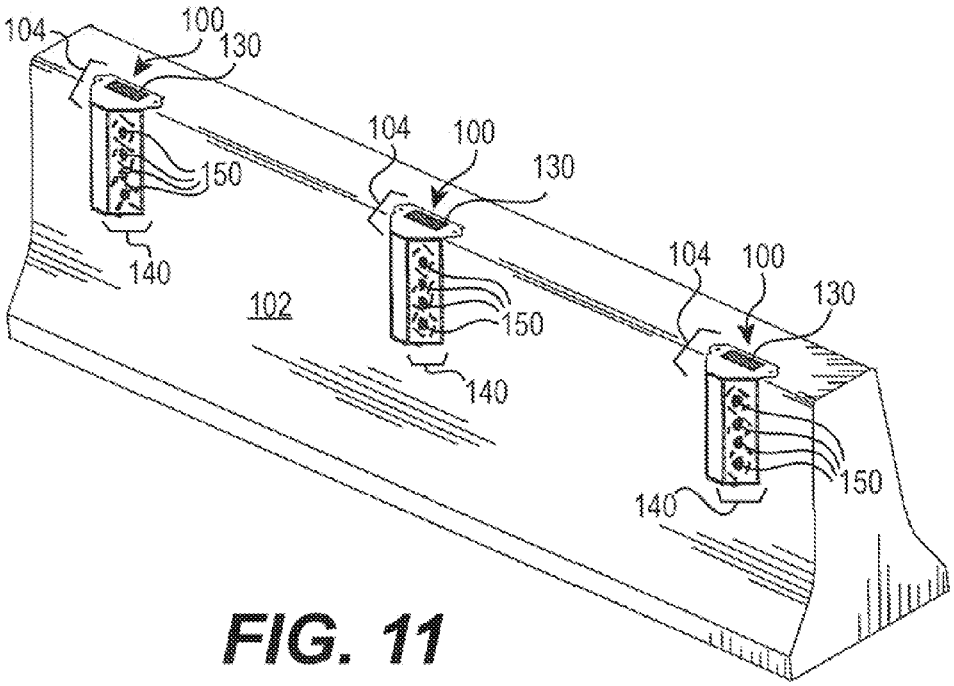
FIG. 11 is a perspective view of three exemplary delineators, in accordance with embodiments of the present disclosure.

FIG. 11 is a perspective view of multiple delineators 100, attached to a roadway barrier 102, consistent with embodiments of the present disclosure. In the exemplary embodiment shown in FIG. 11, each of the delineators 100 comprise a plurality of light sources 150, a solar cell array 130, and reflective tape 140. Delineators 100 are shown in a deployed configuration, where panels 104-116 are arranged in different planes to form a body. The delineators 100 are arranged in a row along roadway barrier 102 and help indicate its edge. In low light conditions, these delineators 100 will emit light from light source 150 so that an oncoming driver will see roadway barrier 102 well before it is fully lit by his or her headlights. Moreover, placing multiple delineators 100 in a row helps indicate roadway barrier 102, and the corresponding danger, that continues for a distance beyond the first set of lights. The number and configuration of these components is exemplary and provided for purposes of illustration in FIG. 11. It will be appreciated from this disclosure that the number and configuration of these and the other components illustrated in FIG. 11 may be modified or adjusted.

The roadway barrier 102 may be made out of any material. Roadway barrier 102 shown in FIG. 11 is made of concrete, for example. Each delineator 100 is shown attached to the top corner of roadway barrier 102. Delineators 100 may vary in size based on factors including, but not limited to, the size and material of roadway barrier 102, manufacturing costs, and highway safety concerns. Each delineator 100 is supported both by its attachment means, which may include epoxy and mechanical devices like screws, and top panel 104, which extends from the body of delineator 100 to the top of roadway barrier 102. In the illustrated embodiment, each delineator 100 forms an upside-down L shape, so that it can be attached to simultaneously to the top and side of the roadway barrier 102. The attachment means can be used on both the top and side contact points with roadway barrier 102.

Figure 12:
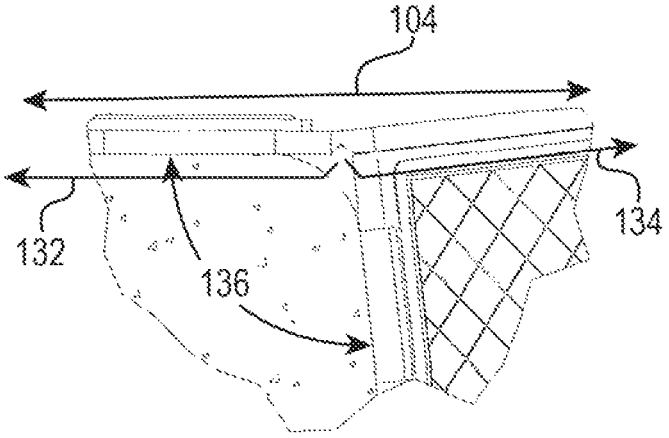
FIG. 12 is a side cutaway view of an exemplary delineator, in accordance with embodiments of the present disclosure.

FIG. 12 shows a side cutaway view of a delineator 100 attached to roadway barrier 102, consistent with embodiments of the present disclosure. Exterior angle 136 is shown here formed between first portion 132 of top panel 104 and left back panel 112. Exterior angle 136 may be any angle, but is shown here to be 96°. Top panel 104 is shaped so as to allow it to flexibly adapt to a variety of exterior angles 136.

Other embodiments will be apparent to those skilled in the art from consideration of the specification and practice of the exemplary embodiments and features disclosed herein. It is intended that the specification and examples be considered as exemplary only, with a true scope and spirit of the embodiments of the present disclosure being indicated by the following claims.

What is claimed is:

1. A delineator that is attachable to a roadway barrier, the delineator being operable between a stowed configuration and a deployed configuration, the delineator comprising:
- at least three panels with flexible connections that connect the panels to one another;
- a solar cell array mounted on at least one of the panels;
- a rechargeable power source attached to at least one of the panels; and
- at least one light source powered by the rechargeable power source mounted on at least one of the panels,
- the panels, in the stowed configuration, being in one of the same or substantially parallel planes, and
- each of the panels, in the deployed configuration, being disposed in a different plane and sharing at least two edges with other panels,
- wherein
  - the rechargeable power source is housed within an enclosure formed by the panels in the deployed configuration; and
  - the at least three panels include:
    - a top panel second portions,
    - a back panel, and
    - and two side panels.

2. The delineator of claim 1, wherein the rechargeable power source is a rechargeable battery and the light source is an LED.

3. The delineator of claim 1, wherein the rechargeable power source is a capacitor and the light source is an LED.

4. The delineator of claim 1, further comprising a microcontroller.

5. The delineator of claim 4, further comprising a printed circuit board.

6. The delineator of claim 1, wherein
- the top panel first portion, in the deployed configuration, is perpendicular to the back and side panels; and
- the top panel second portion, in the deployed configuration, forms an exterior angle with the back panel equal to or greater than 90 degrees.

7. The delineator of claim 6, wherein
- the top panel is triangular in shape; and
- the side panels, in the deployed configuration, are perpendicular to the first portion of the top panel, and form interior angles with the back panel of less than 90 degrees.

8. The delineator of claim 6, wherein
- the at least three panels include a front panel;
- the first portion of the top panel is trapezoidal in shape; and
- the side panels, in the deployed configuration, are perpendicular to the first portion of the top panel, and form interior angles with the back panel of less than 90 degrees.

9. The delineator of claim 7, wherein the at least three panels include a bottom panel.

10. The delineator of claim 8, wherein the at least three panels include a bottom panel.

11. The delineator of claim 6, wherein the connections comprise:
- a plurality of hinges; and
- a plurality of securing members operable to maintain the delineator in the deployed configuration.

12. The delineator of claim 6, wherein the connections comprise hook-and-loop fasteners.

13. The delineator of claim 6, wherein the connections comprise ball joints.

14. The delineator of claim 5, wherein the printed circuit board comprises a wireless radio frequency communication device.

15. A delineator that is attachable to a roadway barrier, the delineator being operable between a stowed configuration and a deployed configuration, the delineator comprising:
- a solar cell array mounted on at least one of the panels;
- at least one light source mounted on at least one of the panels;
- a rechargeable power source that powers the at least one light source attached to at least one of the panels; and a plurality of panels with flexible connections that connect the panels to one another, wherein the rechargeable power source is housed within an enclosure formed by the panels in the deployed configuration, and the panels comprising:

a trapezoidably shaped top panel comprising first and second portions, two back panels, a trapezoidably shaped bottom panel, a front panel, and two side panels.

16. The delineator of claim 15, wherein the flexible connections connect the panels such that in the stowed configuration, the panels are in one of the same or substantially parallel planes.

17. The delineator of claim 15, wherein the flexible connections connect the panels such that in the deployed configuration, the front, side, and back panels are in different planes.

18. The delineator of claim 15, wherein the flexible connections connect the panels such that in the deployed configuration, the first portion of the top panel forms an exterior angle with the two back panels of greater than 30 degrees.

19. The delineator of claim 15, wherein the flexible connections connect the panels such that in the deployed configuration, the side panels are perpendicular to the bottom panel and the first portion of the top panel.

20. The delineator of claim 19, wherein the flexible connections connect the panels such that in the deployed configuration, the side panels form interior angles with the back panels of less than 90 degrees.

21. The delineator of claim 4, wherein the microcontroller is configured to activate lights based on sensor input, scheduling information, or defined patterns.

22. The delineator of claim 6, wherein at least one panel comprises a mounting tab.

* * * * *